US007240990B2

(12) United States Patent
Harada et al.

(10) Patent No.: US 7,240,990 B2
(45) Date of Patent: Jul. 10, 2007

(54) INK CARTRIDGE

(75) Inventors: Kazumasa Harada, Nagano-ken (JP); Kazuhiro Hashii, Nagano-ken (JP); Atsuhiko Takeuchi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 284 days.

(21) Appl. No.: 10/517,590

(22) PCT Filed: Jun. 10, 2003

(86) PCT No.: PCT/JP03/07330

§ 371 (c)(1),
(2), (4) Date: Dec. 9, 2004

(87) PCT Pub. No.: WO03/103973

PCT Pub. Date: Dec. 18, 2003

(65) Prior Publication Data

US 2006/0164480 A1 Jul. 27, 2006

(30) Foreign Application Priority Data

Jun. 11, 2002 (JP) ..... 2002-170018

(51) Int. Cl.
*B41J 2/14* (2006.01)
*B41J 2/175* (2006.01)

(52) U.S. Cl. ..... 347/49; 348/86

(58) Field of Classification Search ..... 347/49, 347/85, 86, 87; 141/2, 18
See application file for complete search history.

(56) References Cited

U.S. PATENT DOCUMENTS 5,619,237 A 4/1997 Inoue et al.
5,777,646 A * 7/1998 Barinaga et al. ..... 347/86
6,036,305 A 3/2000 Nagasaki et al.
6,332,481 B1 * 12/2001 Shinada et al. ..... 141/18
6,460,984 B1 * 10/2002 Matsumoto et al. ..... 347/86
6,786,851 B1 9/2004 Maresh
6,863,388 B2 * 3/2005 Seino et al. ..... 347/86

FOREIGN PATENT DOCUMENTS

| | | | |
|---|---|---|---|
| CN | 1261029 | A | 7/2000 |
| EP | 0 822 084 | A2 | 2/1998 |
| EP | 1 092 546 | A2 | 4/2001 |
| JP | 9-11500 | A | 1/1997 |
| JP | 2002-1987 | A | 1/1997 |
| JP | 2001-88316 | A | 4/2001 |

OTHER PUBLICATIONS

International Search Report dated Jul. 29, 2003, in PCT/JP2003/07330.

* cited by examiner

*Primary Examiner*—Anh T. N. Vo
(74) *Attorney, Agent, or Firm*—Stroock & Stroock & Lavan LLP

(57) ABSTRACT

There are provided a retaining member 4 having a claw portion 4*a* engageable to and disengageable from a recessed portion 15 formed at an ink cartridge mounting portion and a valve body 6 biased by a spring 7 provided at an ink supply port 3, maintaining a normally closed state and resiliently abutting the claw portion 4*a* to the recessed portion 15 by being opened in a state of being inserted with an ink supply needle. Thereby, an ink cartridge providing amounting feeling and dispensing with a spring member for assisting detachment can be provided.

12 Claims, 6 Drawing Sheets

FIG. 2 ( I )
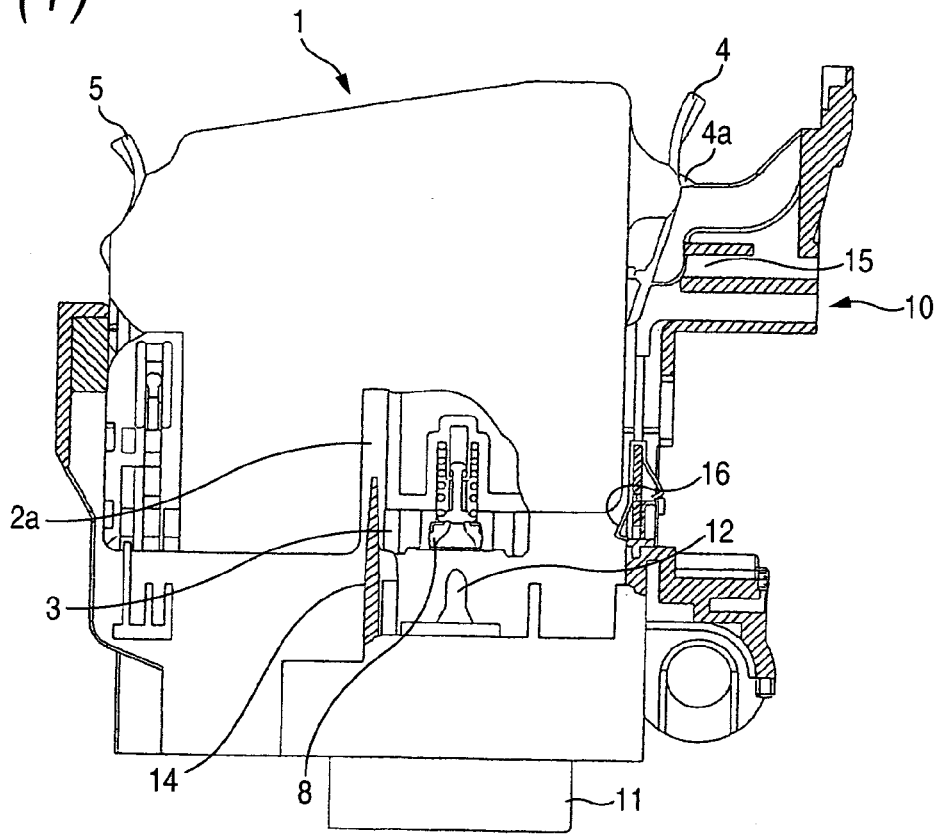
FIG. 2 ( II )
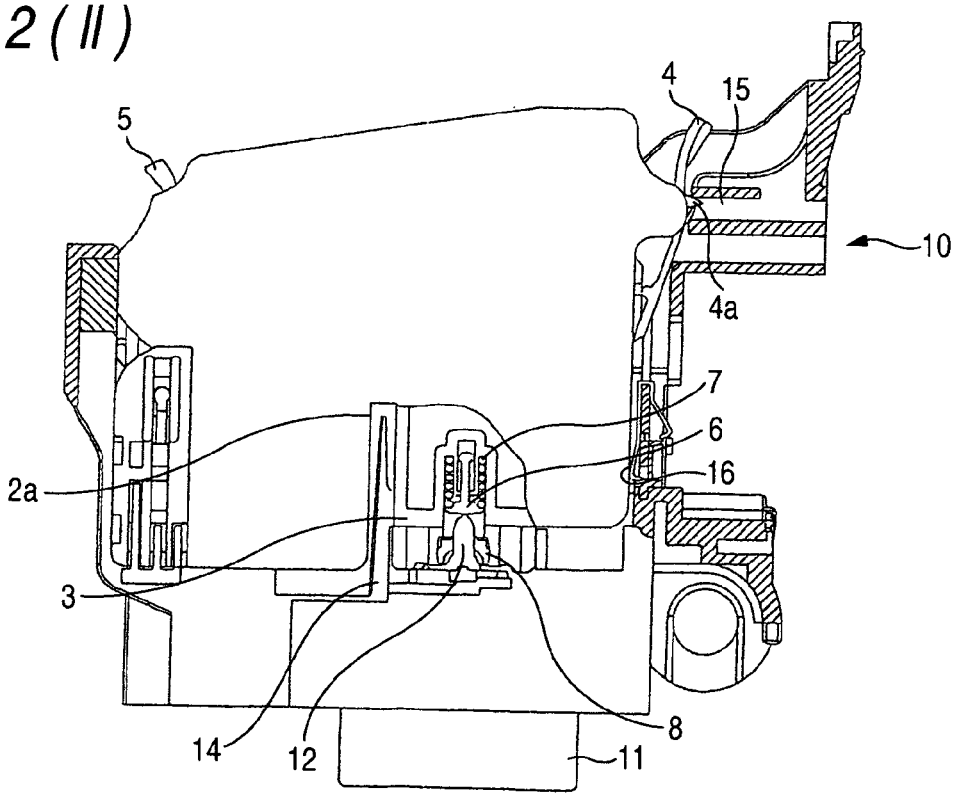

INK CARTRIDGE

TECHNICAL FIELD

The present invention relates to an ink cartridge suitable for a recording apparatus for mounting an ink cartridge to a carriage mounted with an ink jet recording head and supplying ink to the recording head.

BACKGROUND ART

In a recording apparatus in which an ink cartridge is removably mounted on a carriage having an ink jet recording head, that is provided a retaining mechanism that is capable of preventing removal of the carriage by moving the carriage in printing and that is also capable of releasing engagement therebetween easily by external operation.

In Japanese patent publication No. JP-A-10-44451, there is constructed a constitution in which in two side surfaces of a cartridge main body opposed to each other, one of the side surfaces is formed with a projected portion engaging with an ink cartridge mounting portion, further, other of the side surfaces is formed with a claw at a pivotable lever and in a state in which the projected portion is engaged with the ink cartridge mounting portion, the other surface is moved to constitute a rotation fulcrum by the projected portion to thereby engage the claw of the lever to the ink cartridge mounting portion.

However, the mounting mechanism is a mechanism of pivoting to mount the ink cartridge and it is difficult to apply the mechanism to an ink cartridge having a mounting mechanism forming an ink flow path by inserting an ink supply needle communicating with a recording head to an ink supply port of the ink cartridge.

That is, the ink supply needle is provided with a predetermined length in order to secure assured communication with the ink cartridge and therefore, there is a concern that the ink supply needle can break or be damaged when the ink supply needle is subjected to external force in a direction other than an axial direction of the ink supply needle and therefore, the ink cartridge needs to move in parallel with a length direction of the ink supply needle.

Further, there has also been proposed an ink cartridge which is made to be insertable to an ink supply needle by forming elastically deformable levers having claw portions to be engaged with an ink cartridge mounting portion at two surfaces of a container containing ink opposed each other as is seen in JP-A-9-11500.

In such a constitution, it has previously been proposed by the applicant to give perceptible mounting feeling for a user and give resistance feeling by resiliency providing means of a spring or the like in a direction opposed to an insertion direction to be able to detach the cartridge without exerting unreasonable force to the cartridge.

According to the constitution, the spring member needs to provide to either of the ink cartridge or the cartridge mounting portion and a problem of an increase in a number of parts is posed.

Therefore, it is an object of the invention to provide an ink cartridge capable of being securely fixed to a cartridge mounting portion of an ink cartridge, providing cartridge mounting feeling and assisting to detach the cartridge.

DISCLOSURE OF THE INVENTION

An ink cartridge of the invention is constituted such that in an ink cartridge containing ink to a container body and having an ink supply port for supplying the ink to a recording head by engaging with an ink supply needle communicating with the recording head in a state of being mounted to an ink cartridge mounting portion of a recording apparatus, the ink cartridge comprising a retaining member having a projected portion engageable to and disengageable from a recessed portion formed at the ink cartridge mounting portion and valve means having biasing means provided at the ink supply port, normally keeping a closed state of the valve means and opening the valve means to resiliently abut the projected portion to the recessed portion in a state of insertion of the ink supply needle.

By such a constitution, in a procedure of mounting the ink cartridge to the ink cartridge mounting portion, the valve means produces a reaction force by being pushed by the ink supply needle to give a resistance feeling to a user. In the mounted states the claw portion is resiliently abutted by the recessed portion by the reaction force of the valve means to resist against an accelerating or decelerating force in printing. In detaching the ink cartridge, the ink supply port is detached from the ink supply needle by moving in parallel with the ink supply needle by the reaction force of the valve means.

BRIEF DESCRIPTION OF THE DRAWINGS

FIGS. 2(I) and 2(II) are views respectively showing a procedure of mounting the ink cartridge according to the invention to a carriage.

FIG. 4 shows a state of arranging the ink cartridge above a mounting position, FIG. 5 shows a state of pushing downward the ink cartridge by the finger until an ink supply needle is inserted into an ink supply port and FIG. 6 shows a state of fixing the ink cartridge by a mounting lever.

BEST MODE FOR CARRYING OUT THE INVENTION

An explanation will be given here of details of the invention based on illustrated embodiments as follows.

Figure 1:
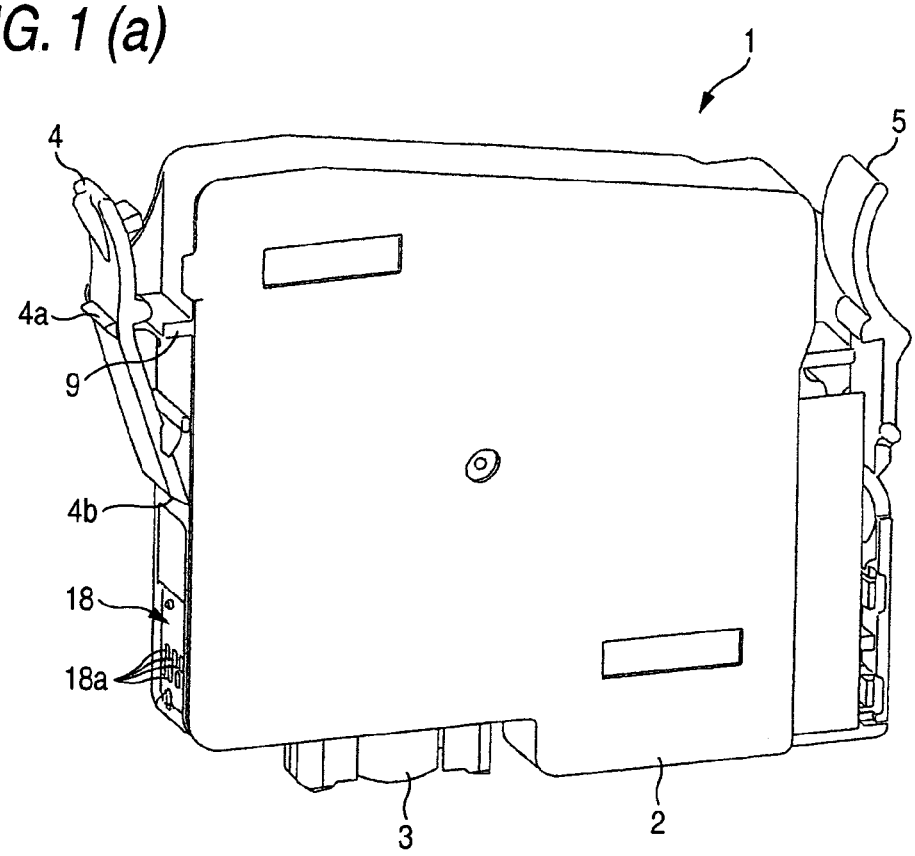
FIGS. 1(*a*) and 1(*b*) are respectively a perspective view showing an embodiment of an ink cartridge according to the invention and a front view partially breaking a vicinity of an ink supply port.
Figure 1:
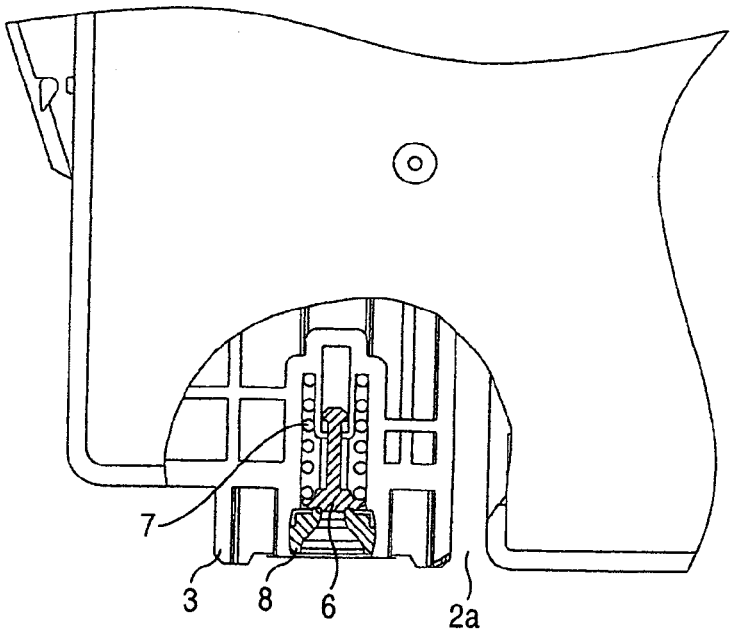

FIGS. 1(*a*) and 1(*b*) respectively show an example of an ink cartridge according to the invention, a cartridge 1 is constituted by forming an ink supply port 3 at a container body 2 containing ink to be offset to one side in a longitudinal direction of a front end side thereof in an insertion direction, or according to the embodiment, a bottom surface thereof and integrally forming a retaining member 4 to a side surface thereof proximate to a side of the ink supply port and a pinching member 5 at other surface thereof. Further, the container body 2 is formed with a slit portion 2*a* extended in a direction of inserting and drawing the cartridge and opened at a front end side thereof on an inserting side at a vicinity of the ink supply port 3.

As shown by FIG. 1(*b*), the ink supply port 3 is mounted with a valve body 6 to be normally closed and opened by inserting an ink supply needle 12 in a state of being biased by a spring 7 which is biasing means to a side of a packing 8 which is a sealing member to be brought into close contact with a surrounding of the ink supply needle to seal. The spring 7 is provided with elastic strength to a degree of resiliently abutting a claw portion 4*a* which is a projected portion of the retaining member (lever) 4 to a face of a recessed portion 15 which is an engaging portion of a carriage opposed to the claw portion of the retaining member 4 even in a state of charging ink fully to the ink cartridge and being mounted to the ink supply needle 12. Further, the spring 7 is preferably set to a strength of resiliently abutting the claw portion 4*a* of the retaining member 4 to the recessed portion 15 for engaging to a degree by which the ink cartridge 1 is not rotated by an acceleration by moving the carriage.

Specifically, a wire member having a diameter of 0.45 mm is wound to constitute a coil outer diameter of ϕ 3.85 mm, an effective turn number of 6.5 turns and a free length of 10.36 mm and when a reaction stress thereof in a state of mounting cartridge is equal to or larger than 200 g, the ink cartridge can be moved by overcoming friction with the packing 8 mounted to the ink supply port 3 and brought into close contact with an outer periphery of the ink supply needle 12 to seal. The packing 8 is formed with an opening smaller than a diameter of the ink supply needle and inserted with the ink supply needle and the valve body 6 is constituted to seal the opening by the spring 7 when the carriage is not mounted.

Further, the reaction stresses is preferably equal to or smaller than 700 g in order to prevent the valve body 6 or the like from being applied with useless load. That is, it is preferable to select the reaction stress to be about 200 g through 700 g. Further, it is preferable that the free length is equal to or lager than 10 mm in order to move to a position offset from an engaging region.

The retaining member 4 disposed to deviate to the side of the ink supply port is constituted such that a rotation fulcrum 4*b* is constituted by a front end side thereof in the insertion direction, or a lower end side thereof according to the embodiment and an upper portion thereof is normally expanded to open and a lower portion thereof is provided with a circuit board 18 formed with memory means for storing information with regard to contained ink.

Further, reference numeral 9 designates a projected potion for stopper for pivoting the retaining member 4 to a degree by which the claw portion 4*a* can be detached from an ink cartridge mounting portion.

Meanwhile, as shown by FIG. 2(I), a carriage 10 constituting a recording apparatus to be mounted with the ink cartridge 1 is provided with a recording head 11 at a bottom surface thereof, and an upper surface thereof is formed with the ink supply needle 12 communicating with the recording head 11 and a projected piece 14 for positioning engaged with the slit 2*a* of the ink cartridge in parallel with the direction of inserting and drawing the ink cartridge 1.

Further, there is formed the recessed portion 15 into which the claw portion 4*a* is dropped at a position opposed to the claw portion 4*a* of the retaining member 4 when the ink cartridge 1 is mounted to a predetermined reference position and there are arranged a plurality of electrodes 16 for forming contacts with a plurality of electrodes 18*a* formed on the circuit board 18 of the ink cartridge 1 on a lower side thereof.

According to the embodiment, as shown by FIG. 2(I), when the ink cartridge is pushed into the carriage by making the ink supply port 3 opposed to the ink supply needle 12, further, directing the claw portion 4*a* of the retaining member 4 to the side of the electrode 16 and holding the ink cartridge 1 by pinching the retaining member 4 and the pinching member 5 by the fingers, the slit portion 2*a* advances further by being guided by the projected piece 14.

When the ink supply port 3 of the cartridge 1 is brought into contact with the ink supply needle 12, a reaction force of the spring 7 resiliently abutting the valve body 6 of the ink supply port 3 is operated. When the ink cartridge 1 is further pushed against the reaction force of the spring 7, as shown by FIG. 2 (II), the claw portion 4*a* of the retaining member 4 is dropped into the recessed portion 15 to engage. Thereby, a perceptible click feeling is given to the finger picking the retaining member 4 and the user can determine that the cartridge has been securely mounted to the carriage 10. Further, it can be determined that the cartridge has been securely mounted to the carriage 10 by click sound when the claw portion 4*a* of the retaining member 4 is dropped into the recessed portion 15 to engage.

In the mounted state, the valve body 6 is opened and ink of the ink cartridge 1 can be supplied to the recording head 11 via the ink supply needle 12 and the electrode 18*a* of the circuit board 18 of the cartridge 1 maintains a state of being brought into contact with the electrode 16.

Since the ink cartridge 1 is biased in a direction opposed to the insertion direction by the spring 7 and the claw portion 4*a* of the retaining member 4 is resiliently abutted by the recessed portion 15, regardless of vibration in printing, a state in which the ink supply port 3 is engaged with the ink supply needle 12 is maintained and the electrode 18*a* of the circuit board 18 forms secure contact with the electrode 16.

Meanwhile, when the ink cartridge 1 is detached from the carriage 10 for replacement or the like, when the retaining member 4 and pinching member 5 are pinched by the fingers, the claw portion 4*a* of the retaining member 4 is detached from the recessed portion 15. Although a frictional resistance is produced between the packing of the ink supply port and the ink supply needle 12 at the cartridge 1, a force produced by the elastic strength of the spring 7 is set to be larger than the force produced by the frictional resistance and therefore, when the claw portion 4*a* of the retaining member 4 is detached from the recessed portion 15, the cartridge is raised in parallel with an axial direction of the ink supply needle 12. Thereby, the ink cartridge 1 can be detached without operating a bending force or the like to the ink supply needle 12.

Figure 3:
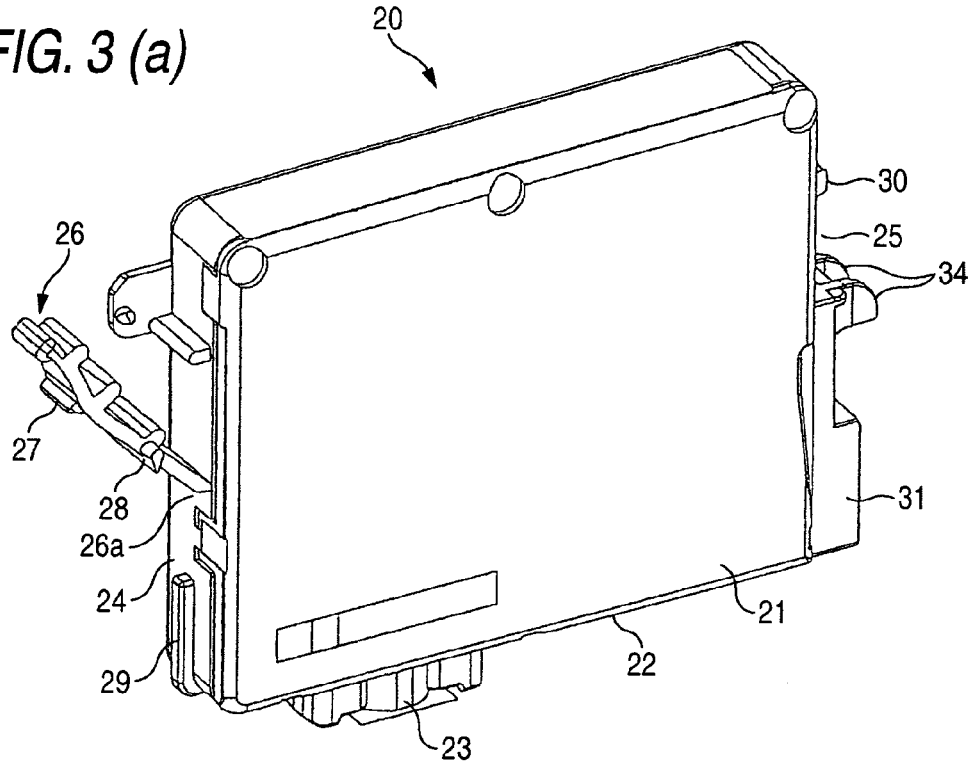
FIGS. 3(*a*) and 3(*b*) are perspective views respectively showing another embodiment of an ink cartridge according to the invention by front and rear structures thereof.
Figure 3:
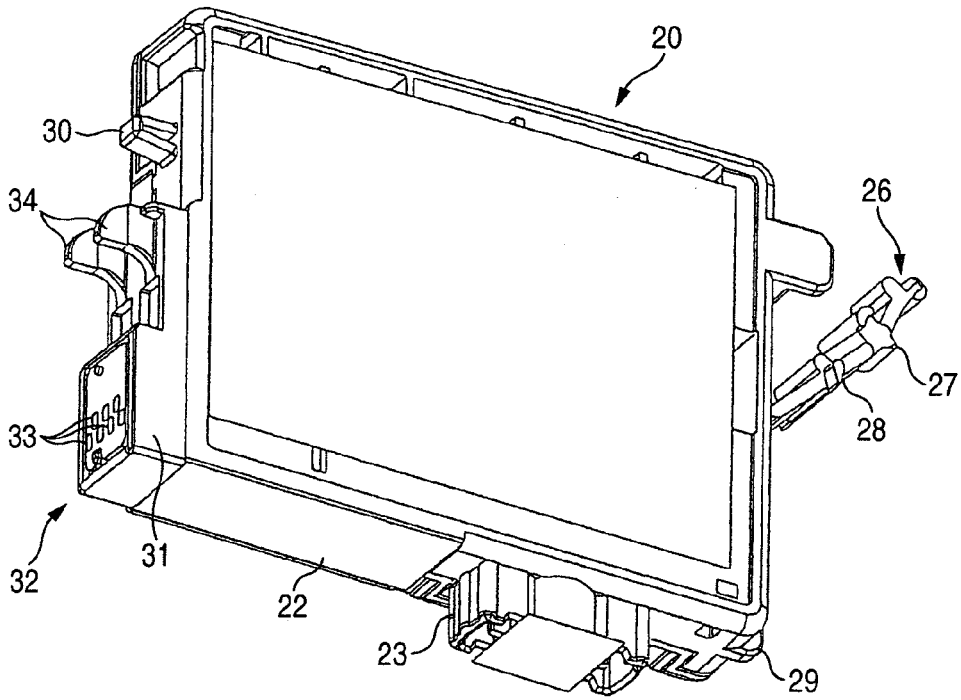

FIGS. 3(*a*) and 3(*b*) respectively show a second embodiment of an ink cartridge according to the invention.

In FIGS. 3(*a*) and 3(*b*), a cartridge 20 is constituted by providing an ink supply port 23 for supplying ink to a recording head 48 by being engaged with an ink supply needle 47 constituting a flow path forming member of a recording head at one wall surface (bottom surface 22) of a container body 21.

The ink supply port 23 is mounted with the valve body 6 to be normally closed and opened by inserting the ink supply needle 12 in the state of being biased by the spring 7 similar to that shown in FIG. 1 (*b*). The spring 7 is provided with the elastic strength to the degree by which the claw portion 4*a* of the retaining member 4 is resiliently abutted to the recessed portion 15 for engaging of the carriage even in the state of charging ink fully to the ink cartridge and being mounted to the ink supply needle 12. Preferably, the spring 7 is set to a strength of resiliently abutting a claw portion 27 of a retaining member 26 to a recessed portion 44 for engaging to a degree by which the ink cartridge 20 is not rotated by acceleration by moving the carriage and a projected portion 30 constituting a pressed portion pressed by a member (charging lever 42 according to the embodiment) of a recording apparatus is resiliently abutted to the charging lever 42 at an upper surface thereof.

The lever 26 which is an elastically deformable retaining member is formed at a wall surface 24 on a side proximate to the ink supply port 23 of two wall surfaces 24 and 25 substantially orthogonal to the wall surface 22 formed with the ink supply port 23 and opposed to each other. According to the lever 26, a lower portion thereof constitutes a rotation fulcrum 26*a* and the lever 26 is provided at the wall surface 24 of the container body 21 elastically deformably and the claw portion 27 which is an attachable and detachable engaging portion is projected outwardly to the engaging portion of the carriage at a portion thereof upward from the rotation fulcrum 26*a* and between the rotation fulcrum 26*a* and the claw portion 27, a projection(s) 28 are respectively formed preferably on both sides to project from the lever main body in side directions. Further, a circuit board formed with a projected portion 29 for guiding extended in the mounting direction is arranged at a lower portion of the lever 26.

Further, the other wall surface 25 is formed with a lever pressure receiving portion, according to the embodiment, the projected portion 30 at a position at which the charging lever of the carriage, mentioned later, can press the lever pressure receiving portion. Downward from the projected portion 30, there is formed a projected portion 32 both sides of which are restricted by the recording apparatus and which is provided with a surface in parallel with the mounting direction, where a plurality of electrodes 33 forming contacts with elastic contact points 46 are formed in two up-and-down staggered row such that a plurality of electrodes 33 are horizontally arranged in each row according to the embodiment. Further, reference numeral 34 in the drawings designates an erroneous insertion preventive identification piece provided as the need.

Figure 4:
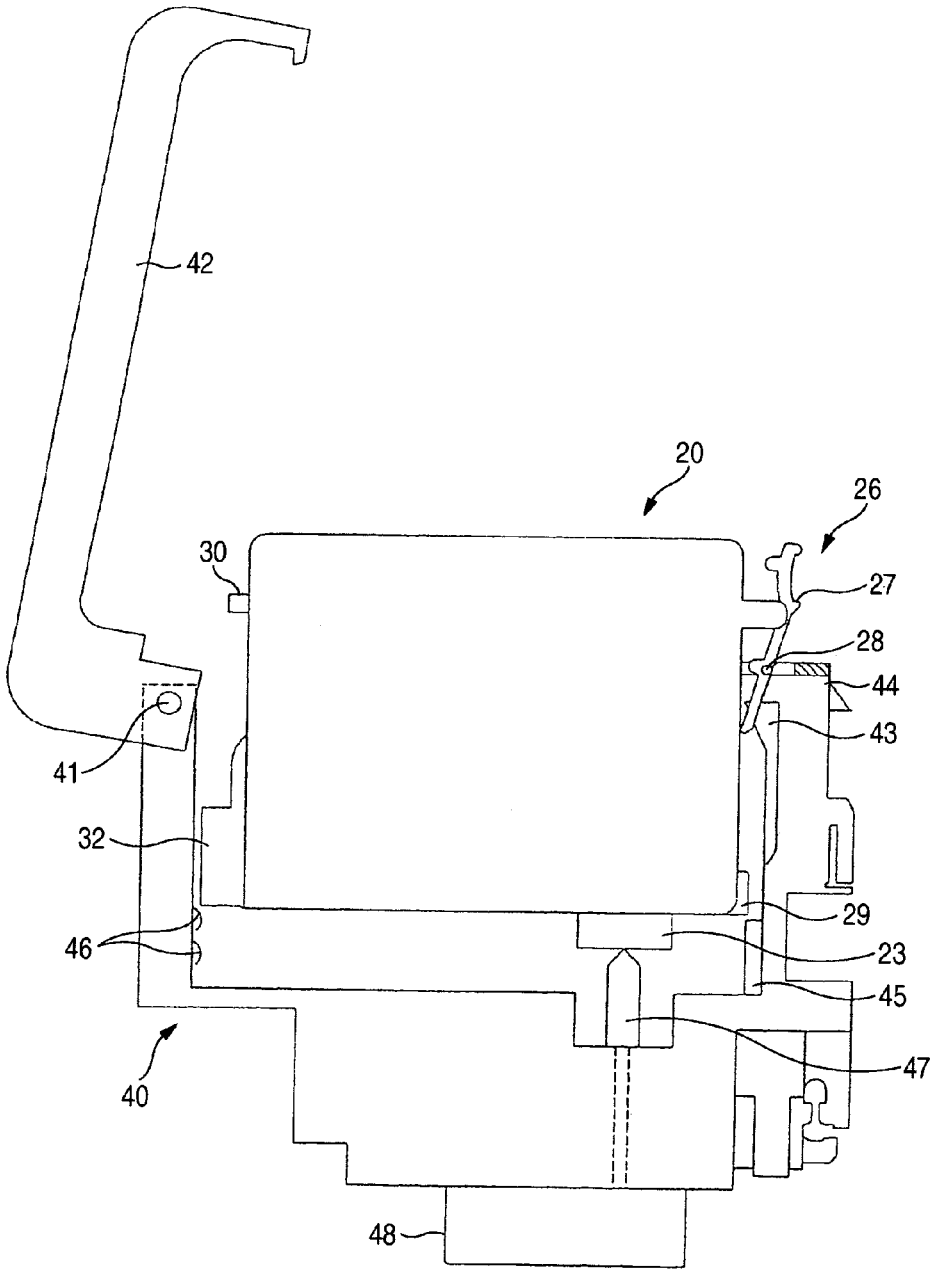
FIG. 4 through FIG. 6 respectively show a procedure of mounting the ink cartridge to the carriage.
Figure 5:
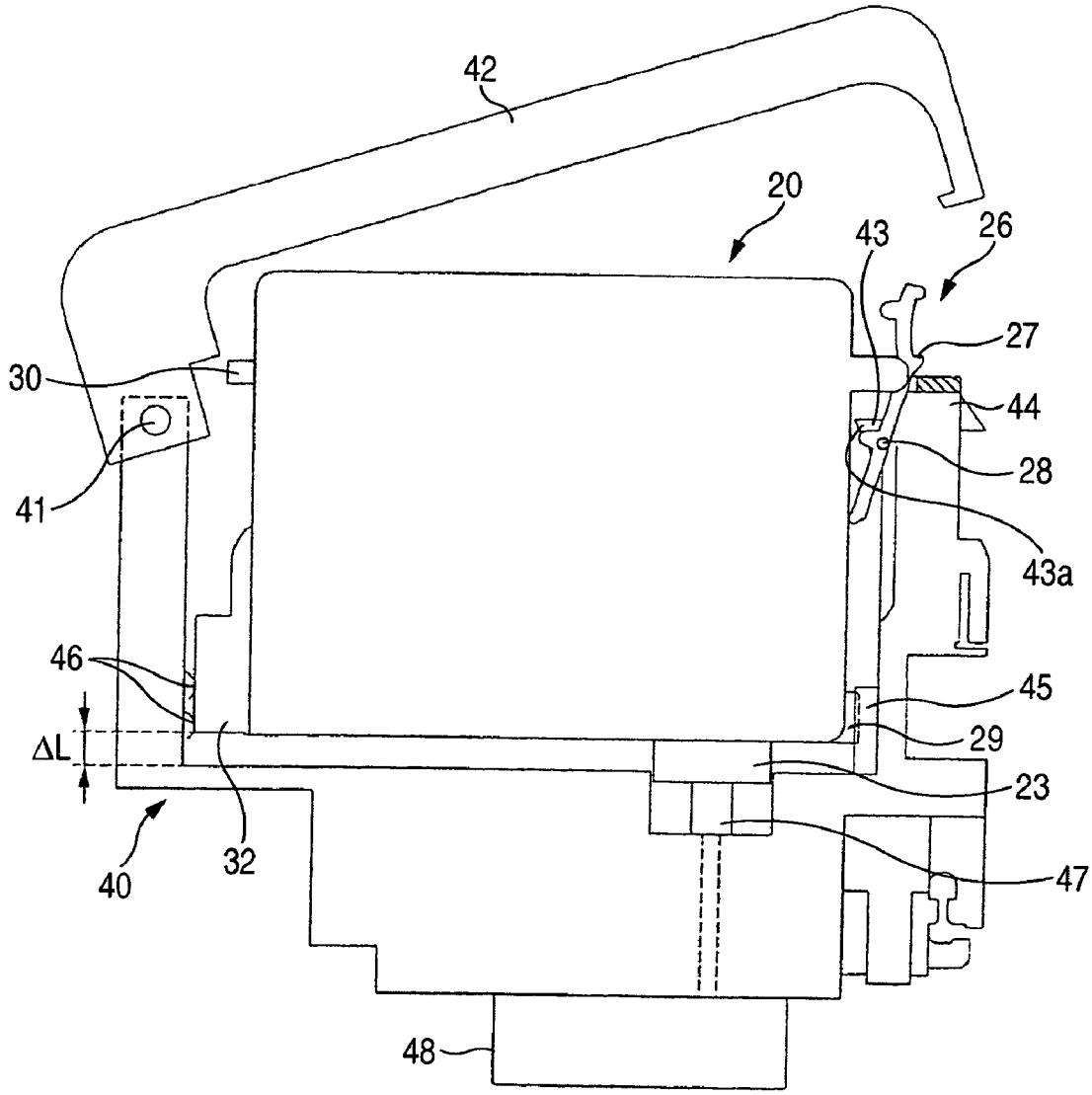
Figure 6:
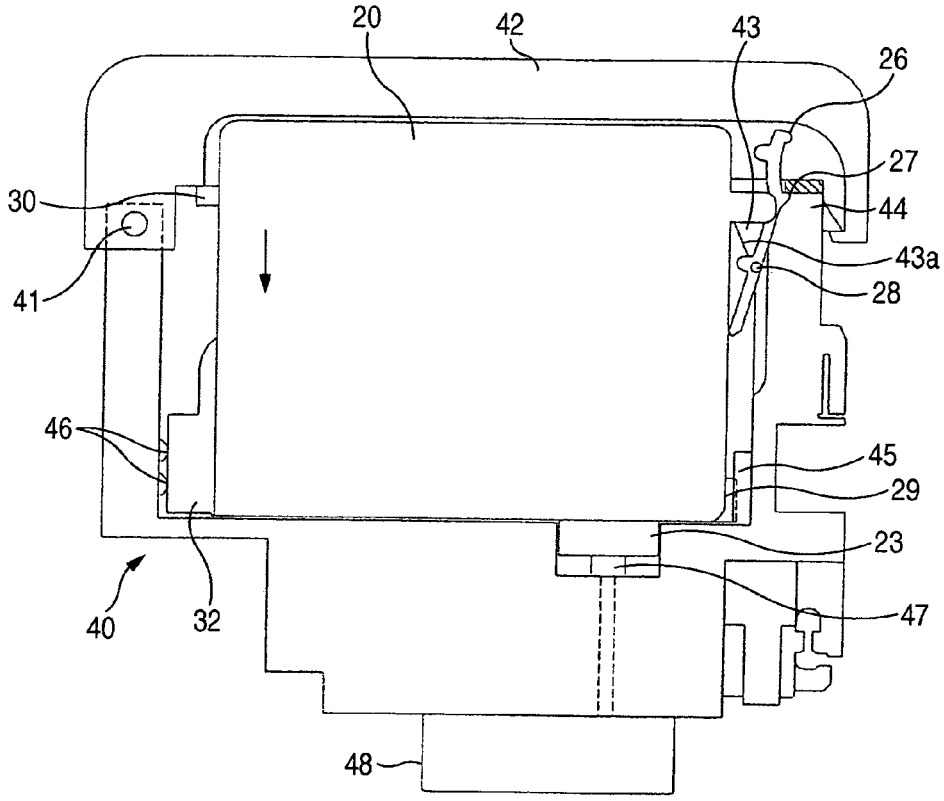

FIG. 4 through FIG. 6 show an embodiment of a recording apparatus suitable for the above-described ink cartridge 20 by a structure of a carriage and a carriage 40 is provided with the mounting lever 42 pivotably attached by a shaft 41 such that a lower side thereof is constituted by a side thereof opposed to the projected portion 30 of the cartridge 20, a groove 43 to be engaged with the projections 28 on the both sides of the lever 26 at a wall surface thereof opposed to the lever 26 and an engaging portion for engaging with the claw portion 27, according to the embodiment, a recessed portion 44.

The grove 43 is formed with an inclined surface 43*a* an upper portion of which is expanded to open to the side of the cartridge and at an initial stage of mounting the ink cartridge, the projections 28 on the both sides are picked up by a wide port regardless of a degree of opening the lever 26 by the inclined surface 43*a*, further, in the mounted state, the lever 26 is operated to expand to open forcibly to the side of the wall surface of the carriage, that is, on the outer side of the ink cartridge 20. Further, downward from the groove 43, a second groove 45 is formed. The groove 45 is engaged with the guide projected portion 29 of the ink cartridge 20 before finishing to mount the ink cartridge and prevent rattling of the ink cartridge in the width direction after finishing to mount the ink cartridge.

At a cartridge containing region of the other wall surface, there is arranged the elastic contact point 46 which is brought into conductive contact with the electrode 33 of the projected portion 30 when the mounting lever 42 is closed up to a predetermined reference position.

According to the embodiment, when the ink cartridge 20 is positioned to a predetermined region of the carriage 40 as shown by FIG. 4, the ink supply port 23 of the ink cartridge is brought into contact with the ink supply needle 47 of the carriage 40 to stop at a predetermined position.

When the ink cartridge 20 is pushed vertically under the state, as shown by FIG. 5, the projections 28 on the both sides of the lever 26 of the ink cartridge 20 are picked up by the inclined surface 43*a* forming an expanded and opened portion and the guide projected portion 29 advances into the groove 45. The ink supply needle 47 communicated with the recording head 48 advances into the ink supply port 23 to push up the valve body 6 against the spring 7.

When the ink cartridge 20 is pushed to a predetermined reference position in this way, the lever 26 is pivoted by the inclined surface 23*a* of the carriage 40 by constituting a fulcrum by a region fixed to a predetermined position on an outer side and the claw 27 is dropped into the recessed portion 44 which is the engaging portion by strong elastic force. Under the state, other side of the ink cartridge 20 is brought into a state of being free to some degree and therefore, there is brought about a state of pivoting by some degree by being pressed by the spring 7 by constituting a fulcrum by a point at which the claw 27 and the recessed portion 44 are brought into contact with each other.

When the mounting lever 42 is pivoted to close under the state, in the procedure, an axially supporting side of the mounting lever 42 is moved down to a predetermined position to press the projected portion 30 and as shown by FIG. 6, the electrode 33 normally forms a conductive relationship with elastic contact point 46. Under the state, according to the ink cartridge 20, the coil spring 7 of the ink supply port 23 is compressed by the ink supply needle 47 via the valve body 6 and pressed by the mounting lever 42 and therefore, a position thereof in an up and down direction is restricted by a position of the mounting lever 42.

Meanwhile, when the ink cartridge 20 is detached from the carriage 40, the projected portion 30 is brought into a free state by opening the mounting lever 42 as shown by FIG. 5. When the lever 26 is deformed to attract to the side of the cartridge by touching the forefinger to the lever 26, the lever 16 is elastically deformed and the claw 27 is detached from the recessed portion 44 which is the engaging portion. The ink cartridge 20 losing support by the recessed portion 44 is moved upwardly by a distance $\Delta L$ by bias force of the spring 7 of the ink supply port 23 and the claw 27 of the lever 16 is moved to outside of the region of the recessed portion 44. By lifting the ink cartridge 20 upwardly at the stage, the ink cartridge 20 can be detached from the carriage 40.

INDUSTRIAL APPLICABILITY

As described above, according to the ink cartridge of the invention, the ink cartridge can be raised in the direction in parallel with the ink supply needle while providing the mounting feeling and dispensing with a spring member as a separate member for assisting to detach.

The invention claimed is:

1. An ink cartridge, comprising:

an ink chamber, storing ink;

an ink supply port, communicating with the ink chamber, and adapted to engage with an ink supply needle formed in a mounting portion of a recording apparatus, so that the ink is supplied to a recording head of the recording apparatus when the ink cartridge is mounted in the mounting portion;

a retaining member, having a projected portion adapted to engage with an engaging portion formed in the mounting portion;

a valve device, having a biasing member provided in the ink supply port and configured to normally keep closed the valve device, wherein, when the ink supply needle is inserted to the ink supply port, the valve device is opened against the biasing member so as to resiliently abut the projected portion to the engaging portion, wherein the valve device includes a valve body and a coil spring.

2. The ink cartridge according to claim 1 wherein said valve device includes a sealing member for resiliently abutting a surrounding of the ink supply needle, and a valve body brought into contact with said sealing member and said biasing member for pressing said valve body to said sealing member.

3. An ink cartridge, comprising:

an ink chamber, storing ink;

an ink supply port, communicating with the ink chamber, and adapted to engage with an ink supply needle formed in a mounting portion of a recording apparatus, so that the ink is supplied to a recording head of the recording apparatus when the ink cartridge is mounted in the mounting portion;

a retaining member, having a projected portion adapted to engage with an engaging portion formed in the mounting portion;

a valve device, having a biasing member provided in the ink supply port and configured to normally keep closed the valve device, wherein, when the ink supply needle is inserted to the ink supply port, the valve device is opened against the biasing member so as to resiliently abut the projected portion to the engaging portion, wherein said ink chamber is provided with a projected portion for a stopper capable of pivoting said retaining member such that said projected portion is detachable from the mounting portion.

4. An ink cartridge, comprising:

an ink chamber, storing ink;

an ink supply port, communicating with the ink chamber, and adapted to engage with an ink supply needle formed in a mounting portion of a recording apparatus, so that the ink is supplied to a recording head of the recording apparatus when the ink cartridge is mounted in the mounting portion;

a retaining member, having a projected portion adapted to engage with an engaging portion formed in the mounting portion;

a valve device, having a biasing member provided in the ink supply port and configured to normally keep closed the valve device, wherein, when the ink supply needle is inserted to the ink supply port, the valve device is opened against the biasing member so as to resiliently abut the projected portion to the engaging portion, wherein said biasing member is provided with a length and an elastic force such that said biasing member moves a claw portion of said retaining member to outside of said engaging portion when an engagement between said retaining member and the mounting portion is released.

5. An ink cartridge, comprising:

an ink chamber, storing ink;

an ink supply port, communicating with the ink chamber, and adapted to engage with an ink supply needle formed in a mounting portion of a recording apparatus, so that the ink is supplied to a recording head of the recording apparatus when the ink cartridge is mounted in the mounting portion;

a retaining member, having a projected portion adapted to engage with an engaging portion formed in the mounting portion;

a valve device, having a biasing member provided in the ink supply port and configured to normally keep closed the valve device, wherein, when the ink supply needle is inserted to the ink supply port, the valve device is opened against the biasing member so as to resiliently abut the projected portion to the engaging portion, wherein a stress provided by said biasing member is set to a range of 200 g through 700 g when said cartridge is mounted.

6. An ink cartridge, comprising:

an ink chamber, storing ink;

an ink supply port, communicating with the ink chamber, and adapted to engage with an ink supply needle formed in a mounting portion of a recording apparatus, so that the ink is supplied to a recording head of the recording apparatus when the ink cartridge is mounted in the mounting portion;

a retaining member, having a projected portion adapted to engage with an engaging portion formed in the mounting portion;

a valve device, having a biasing member provided in the ink supply port and configured to normally keep closed the valve device, wherein, when the ink supply needle is inserted to the ink supply port, the valve device is opened against the biasing member so as to resiliently abut the projected portion to the engaging portion, wherein said biasing member is provided with an elastic force such that said ink chamber is moved in a direction opposed to an insertion direction against a friction force between a sealing member and the ink supply needle when said biasing member releases an engagement between said retaining member and the mounting portion.

7. An ink cartridge, comprising:

an ink chamber, storing ink;

an ink supply port, communicating with the ink chamber, and adapted to engage with an ink supply needle formed in a mounting portion of a recording apparatus, so that the ink is supplied to a recording head of the recording apparatus when the ink cartridge is mounted in the mounting portion;

a retaining member, having a projected portion adapted to engage with an engaging portion formed in the mounting portion;

a pressed portion, opposing the retaining member through the ink chamber, and having a face adapted to be pressed by a member of the recording apparatus;

a valve device, having a biasing member provided in the ink supply port and configured to normally keep closed the valve device, wherein, when the ink supply needle is inserted to the ink supply port, the valve device is opened against the biasing member so as to resiliently abut the projected portion to the member of the recording apparatus, wherein said ink chamber is provided with a projected portion for a stopper capable of pivoting said retaining member such that said projected portion is detachable from said mounting portion.

8. The ink cartridge according to claim 7, wherein said valve device includes a valve body and a coil spring.

9. The ink cartridge according to claim 7, wherein said valve device includes a sealing member for resiliently abutting a surrounding of said ink supply needle, and a valve body brought into contact with said sealing member and said biasing member for pressing said valve body to said sealing member.

10. An ink cartridge, comprising:

an ink chamber, storing ink;

an ink supply port, communicating with the ink chamber, and adapted to engage with an ink supply needle formed in a mounting portion of a recording apparatus, so that the ink is supplied to a recording head of the recording apparatus when the ink cartridge is mounted in the mounting portion;

a retaining member, having a projected portion adapted to engage with an engaging portion formed in the mounting portion a pressed portion, opposing the retaining member through the ink chamber, and having a face adapted to be pressed by a member of the recording apparatus;

a valve device, having a biasing member provided in the ink supply port and configured to normally keep closed the valve device, wherein, when the ink supply needle is inserted to the ink supply port, the valve device is opened against the biasing member so as to resiliently abut the projected portion to the member of the recording apparatus, wherein said biasing member is provided with a length and an elastic force such that said biasing member moves a claw portion of said retaining member to outside of said engaging portion when an engagement between said retaining member and said mounting portion is released.

11. An ink cartridge, comprising:

an ink chamber, storing ink;

an ink supply port, communicating with the ink chamber, and adapted to engage with an ink supply needle formed in a mounting portion of a recording apparatus, so that the ink is supplied to a recording head of the recording apparatus when the ink cartridge is mounted in the mounting portion;

a retaining member, having a projected portion adapted to engage with an engaging portion formed in the mounting portion;

a pressed portion, opposing the retaining member through the ink chamber, and having a face adapted to be pressed by a member of the recording apparatus;

a valve device, having a biasing member provided in the ink supply port and configured to normally keep closed the valve device, wherein, when the ink supply needle is inserted to the ink supply port, the valve device is opened against the biasing member so as to resiliently abut the projected portion to the member of the recording apparatus, wherein a stress provided by said biasing member is set to a range of 200 g through 700 g when said cartridge is mounted.

12. An ink cartridge, comprising:

an ink chamber, storing ink;

an ink supply port, communicating with the ink chamber, and adapted to engage with an ink supply needle formed in a mounting portion of a recording apparatus, so that the ink is supplied to a recording head of the recording apparatus when the ink cartridge is mounted in the mounting portion;

a retaining member, having a projected portion adapted to engage with an engaging portion formed in the mounting portion;

a pressed portion, opposing the retaining member through the ink chamber, and having a face adapted to be pressed by a member of the recording apparatus;

a valve device, having a biasing member provided in the ink supply port and configured to normally keep closed the valve device, wherein, when the ink supply needle is inserted to the ink supply port, the valve device is opened against the biasing member so as to resiliently abut the projected portion to the member of the recording apparatus, wherein said biasing member is provided with an elastic force such that said ink chamber is moved in a direction opposed to an insertion direction against a friction force between sealing member and said ink supply needle when said biasing member releases an engagement between said retaining member and said mounting portion.

* * * * *